US005228846A

United States Patent [19]

Lammers et al.

[11] Patent Number: 5,228,846

[45] Date of Patent: Jul. 20, 1993

[54] SPLINE REDUCTION EXTENSION FOR AUXILLIARY DRIVE COMPONENT

[75] Inventors: Matthew Lammers, St.Louis Park; Sohan Uppal, Bloomington, both of Minn.

[73] Assignee: Eaton Corporation, Cleveland, Ohio

[21] Appl. No.: 994,437

[22] Filed: Dec. 21, 1992

Related U.S. Application Data

[63] Continuation of Ser. No. 797,672, Nov. 25, 1991, abandoned.

[51] Int. Cl.[5] ..... F03C 2/08

[52] U.S. Cl. ..... 418/61.3

[58] Field of Search ..... 418/61.3

[56] References Cited

U.S. PATENT DOCUMENTS 3,680,987 8/1972 Ohrberg ..... 418/61.3
4,435,130 3/1984 Ohrberg et al. ..... 418/61.3
4,992,034 2/1991 Uppal ..... 418/61.3
5,056,994 10/1991 Eisenmann et al. ..... 418/61.3

*Primary Examiner*—John J. Vrablik
*Attorney, Agent, or Firm*—L. J. Kasper

[57] ABSTRACT

A gerotor motor is disclosed of the type including a stationary, internally-toothed ring member (21;221) and an externally-toothed star member (23;223) orbiting and rotating within the ring member. The motor is of the type utilizing a valving member (53;253) of the "low-speed" type, which rotates at the speed of rotation of the star member. The star member defines internal splines (43;243) and in engagement therewith is an insert member (79;279) which is, in turn, in splined engagement with a valve drive shaft (47;247). The insert member (79;279) extends axially beyond the star member and is received within an adjacent annular recess (85;285), thus maximizing the spline length available for engagement with the main drive shaft (39;239), and maximizing the torque capacity of the motor.

19 Claims, 3 Drawing Sheets

SPLINE REDUCTION EXTENSION FOR AUXILLIARY DRIVE COMPONENT

This application is a continuation of application Ser. No. 07/797,672, filed Nov. 25, 1991, abandoned.

BACKGROUND OF THE DISCLOSURE

The present invention relates to low-speed, high-torque gerotor motors, and more particularly, to such motors of the type having a separate valve drive shaft driving the valve member.

A typical gerotor motor of the type to which the present invention relates includes a housing defining inlet and outlet ports, and a gerotor gear set. The typical motor further includes valve means to provide fluid communication between the ports and the volume chambers of the gerotor gear set. The invention is especially advantageous when used in a device wherein the gerotor set includes an orbiting and rotating externally-toothed star member, and will be described in connection therewith.

In most gerotor motors, an externally-splined main drive shaft (dogbone) is used to transmit torque from the orbiting and rotating star member to the rotating output shaft. A gerotor motor having a "separate" or "two-piece" valve drive is one in which the valve member is disposed "behind" the gerotor, i.e., at the end of the motor opposite the output shaft, with the output shaft typically being considered the "forward" end of the motor. Conventionally, in such motors, the valve is driven at the speed of rotation of the gerotor star member by means of a valve drive shaft which is in splined engagement with both the valve member and the gerotor star member. See for example, U.S. Pat. No. 4,992,034, assigned to the assignee of the present invention.

In most gerotor motors, the limitation on the torque-transmitting capability of the motor is the strength of the spline connection between the star member and the dogbone. In motors using two-piece valve drives, a portion of the axial length of the splines defined by the gerotor star member is required, merely to drive the valve drive shaft. Driving the valve member, whether it be a disk valve or a spool valve, requires a very small percentage of the total torque output of the motor, but typically, the spline connection between the star member and the orbiting and rotating valve drive shaft has taken up a significant portion of the gerotor star splines. This becomes a more serious problem in the case of relatively small displacement motors, in which the axial length of the gerotor may be on the order of one-half inch.

SUMMARY OF THE INVENTION

Accordingly, it is an object of the present invention to provide an improved valve drive arrangement for a gerotor motor which permits an increase in the overall torque capacity of the motor.

It is a more specific object of the present invention to provide an improved valve drive arrangement which utilizes less of the axial length of the star splines, thus leaving more of the axial length of the star splines for engagement with the main drive shaft.

It is another object of the present invention to provide an improved valve drive arrangement wherein the central opening in the valve member can have a smaller diameter, such that the various ports and passages in the valve member can be larger, especially in the radial dimension.

The above and other objects of the invention are accomplished by the provision of an improved rotary fluid pressure device of the type including housing means having fluid inlet means and fluid outlet means. A fluid energy translating displacement means is associated with the housing means and includes a stationary, internally-toothed member, and an externally-toothed member eccentrically disposed within the internally-toothed member, and having orbital and rotational movement relative to the internally-toothed member, to define expanding and contracting fluid volume chambers, in response to the orbital and rotational movement. Valve means cooperates with the housing means to provide fluid communication between the inlet means and the expanding fluid volume chambers and between the contracting fluid volume chambers and the outlet means. Input-output shaft means are provided, and means for transmitting torque between the externally-toothed member and the input-output shaft means. The valve means comprises a generally cylindrical valve member defining valving passages and being rotated at the same speed of rotation of the externally-toothed member. A valve drive shaft operable to translate the orbital and rotational movement of the externally-toothed member into rotational movement of the valve member is provided.

The improved device is characterized by a generally cylindrical insert member defining a set of external, straight splines in engagement with a mating set of internal, straight splines defined by the externally-toothed member, at least a substantial portion of the insert member extending axially beyond the externally-toothed member, toward the valve member. The insert member defines a set of internal, straight splines in engagement with a mating first set of external, crown splines defined by the valve drive shaft.

DESCRIPTION OF THE PREFERRED EMBODIMENTS

Figure 1:
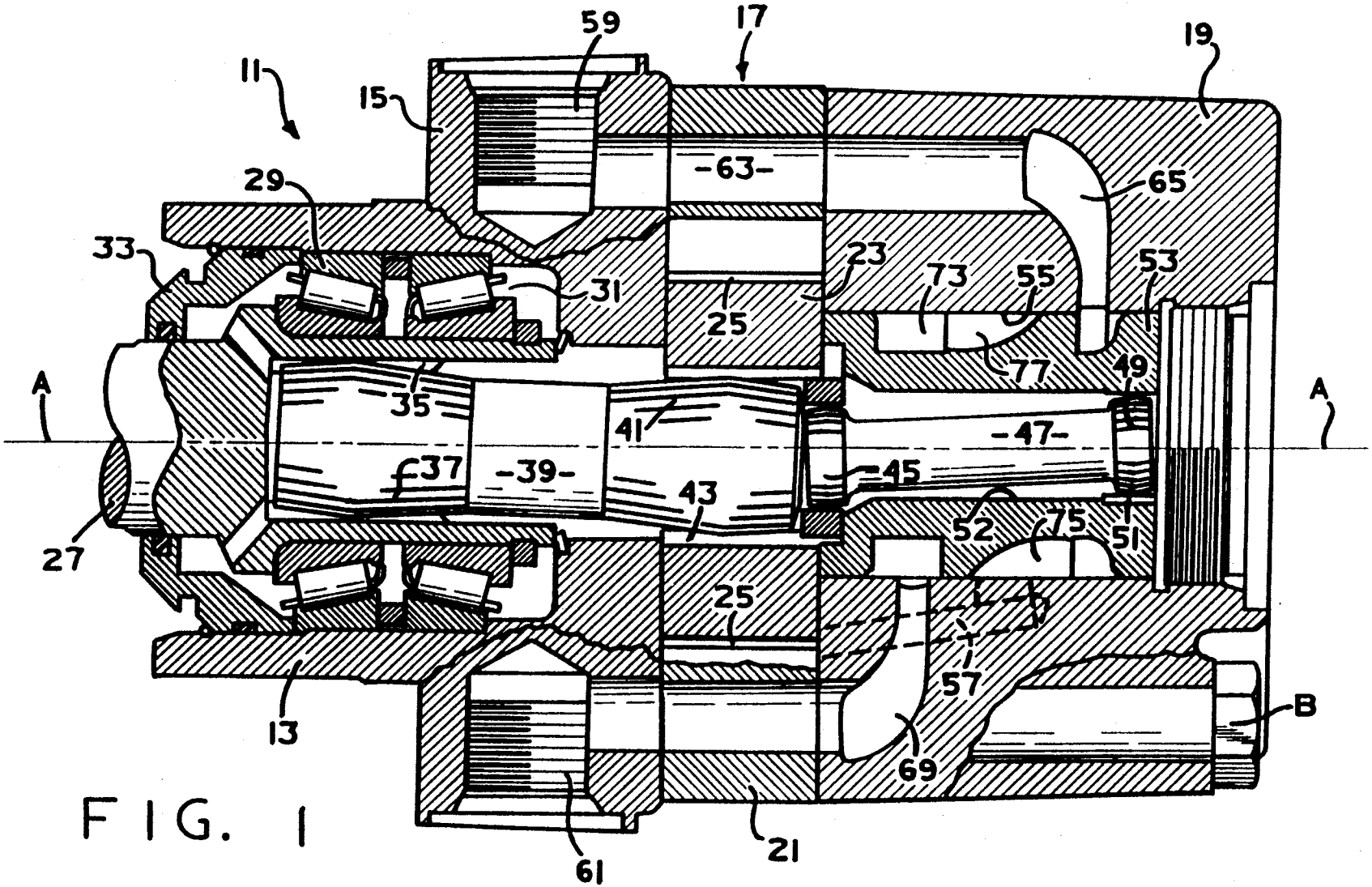
FIG. 1 is an axial cross-section of a low-speed, high-torque spool valve gerotor motor made in accordance with the present invention.

Referring now to the drawings, which are not intended to limit the invention, FIG. 1 illustrates a low-speed, high-torque gerotor motor of the general type illustrated and described in detail in U.S. Pat. No. 4,992,034, assigned to the assignee of the present invention and incorporated herein by reference. The motor, generally designated 11, comprises a plurality of sections secured together, such as by a plurality of bolts B, only one of which is shown in FIG. 1, and then, only fragmentarily.

The motor 11 includes a shaft support casing 13, including an enlarged portion 15. The motor further includes a gerotor displacement mechanism 17, and a valve housing section 19. The gerotor displacement mechanism 17 is well known in the art, is shown and described in U.S. Pat. No. 4,533,302, assigned to the assignee of the present invention, and will be described only briefly herein. More specifically, the gerotor mechanism 17 comprises an internally-toothed ring member 21, and an externally-toothed star member 23, eccentrically disposed within the ring member 21, and having one less tooth than the ring member 21. In the subject embodiment, the star member 23 orbits and rotates relative to the ring member 21, and this orbital and rotational movement defines a plurality of expanding and contracting fluid volume chambers 25.

Referring still to FIG. 1, the motor includes an output shaft 27 positioned within the shaft support casing 13, and rotatably supported therein by suitable bearing sets 29 and 31. Disposed adjacent the forward end of the bearing set 29 is a bearing retainer and snap ring assembly, generally designated 33. The output shaft 27 includes a set of internal, straight splines 35, and in engagement therewith is a set of external, crowned splines 37, formed on a forward end of a main drive shaft 39. Disposed toward a rearward end of the main drive shaft 39 is another set of external, crowned splines 41, in engagement with a set of internal, straight splines 43, formed on the inside diameter of the star member 23. In the subject embodiment, the ring member 21 includes nine internal teeth, and the star member 23 includes eight external teeth. Therefore, eight orbits of the star 23 result in one complete rotation thereof, and one complete rotation of the main drive shaft 39, and of the output shaft 27. It should be understood by those skilled in the art that "input-output shaft means", as used hereinafter in the claims, may refer to either the output shaft 27 (which may comprise an input shaft if the motor is being used as a pump), and/or the main drive shaft 39.

Also in engagement, but only indirectly, with the internal splines 43 of the star member 23 is a set of external, crowned splines 45, formed about one end of a valve drive shaft 47 which has, at its opposite end, another set of external, crowned splines 49 in engagement with a set of internal, straight splines 51 formed about the inner periphery of a central opening 52 of a valve spool, generally designated 53. The details of the indirect connection between the internal splines 43 and the external splines 45, which comprises an important aspect of the present invention, will be described in detail subsequently. The valve spool 53 is rotatably disposed within the valve housing section 19, and more particularly, is rotatably disposed within a valve bore 55. The valve housing section 19 also defines a plurality of fluid passages 57 (only one of which is shown in FIG. 1, and in dashed lines), each of which is disposed to be in continuous fluid communication with an adjacent fluid volume chamber 25. In the subject embodiment, there are nine of the fluid passages 57, because the ring member 21 has nine internal teeth, and therefore, defines nine of the volume chambers 25.

Referring still to FIG. 1, the enlarged portion 15 of the shaft support casing 13 defines an inlet port 59 and an outlet port 61. The inlet port 59 communicates through an axial fluid passage 63 which extends through the casing 13, the ring member 21, and the valve housing section 19, terminating in a cored portion 65. Similarly, the outlet port communicates through an axial fluid passage 67 with a cored portion 69. The passage 63 and cored portion 65 communicate pressurized, inlet fluid into an annular groove 71 defined by the valve spool 53. Similarly, low pressure, return fluid is communicated from an annular groove 73 by the cored portion 69 and passage 67 to the outlet port 61. In open communication with the annular groove 71 is a plurality of timing slots 75, and in open communication with the annular groove 73 is a plurality of timing slots 77. As is well known to those skilled in the art of low-speed, commutating valving, the timing slots 75 and 77 provide commutating fluid communication with the fluid passages 57, thereby providing, in the fluid volume chambers 25 of the gerotor 17, a rotating pattern of high-pressure and low-pressure, wherein the pattern rotates at the rotational speed of the star member 23. This type of valving is referred to as "low speed" valving, in contrast to "high speed" valving, wherein the pattern rotates at the faster, orbiting speed of the star member 23. Therefore, in the subject embodiment, there are eight of the timing slots 75 and eight of the timing slots 77, as is now well known to those skilled in the art.

Figure 2:
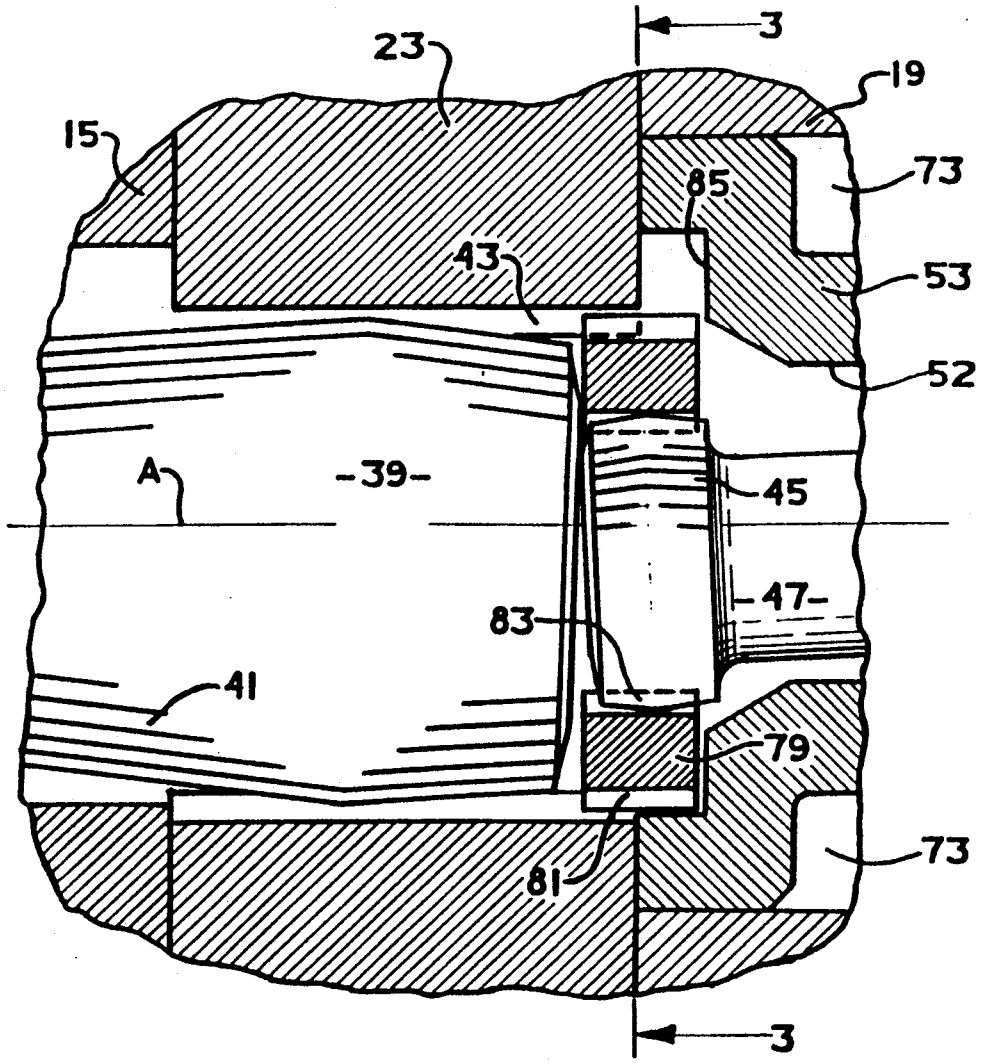
FIG. 2 is an enlarged, fragmentary, axial cross-section, similar to FIG. 1, illustrating primarily the gerotor star and drive area.

Referring now to FIG. 2, the indirect drive connection between the star 23 and the valve drive shaft 47 will be described in detail. Disposed adjacent the rearward end (right end in FIG. 2) of the main drive shaft 39 is an insert member 79. The insert member 79 defines a set of external, straight splines 81, which are in engagement with the straight splines 43 defined by the star member 23. In addition, the insert member 79 defines a set of internal, straight splines 83, which are in engagement with the crowned splines 45 at the forward end of the valve drive shaft 47.

Figure 3:
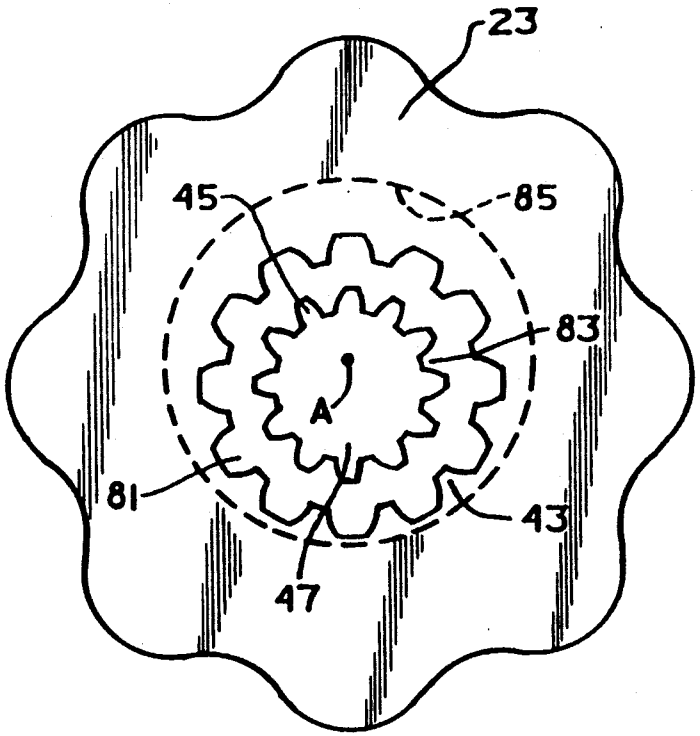
FIG. 3 is a somewhat reduced, transverse cross-section, taken on line 3—3 of FIG. 2.

It is one important advantage of the present invention that only a portion of the insert member 79 may be disposed within the star member 23, i.e., only a portion of the axial length of the external splines 81 is in engagement with the internal splines 43. In the embodiment of FIGS. 1 through 3, the valve spool 53 is disposed immediately adjacent the star member 23 and defines a generally annular recess 85. As is well known to those skilled in the art, the orbital and rotational movement of the star member 23, relative to the ring member 21 results in the total area traversed by the insert member 79 being larger than the member 79. Specifically, the diameter of the annular recess 85 must be equal to at least the overall diameter of the insert member 79, plus twice the eccentricity of the star member 23. Furthermore, the annular recess 85 is concentric with the axis of rotation A of the motor 11.

The amount of torque required to rotate the valve spool 53 is a relatively small percentage of the total torque output of the gerotor mechanism 17. The spline connection between the internal splines 83 and the external, crowned splines 45 is designed to transmit whatever torque is required to rotate the valve spool 53 (plus and appropriate design safety factor), and the axial length of engagement between the external splines 81 and the internal splines 43 may be selected to provide approximately the same torque transmission capability as that between the splines 45 and 83. As is well known to those skilled in the art, a substantially greater axial length of crowned spline-to-straight spline engagement is required to provide the same torque capacity as a straight spline-to-straight spline connection.

As a result of the use of the insert member 79, and the decreased axial length of engagement required with the splines 43, there may now be, as shown in FIG. 2, an increase in the length of engagement between the crowned splines 41 and the internal splines 43. As was mentioned in the Background of the Disclosure, the connection between the gerotor star 23 and the dogbone or main drive shaft 39 is typically the limiting factor on the output torque of a gerotor motor. Therefore, being able to increase the axial length of spline engagement between the star member 23 and the drive shaft 39 typically results in a proportional increase in the torque capacity of the motor.

In FIG. 2, there is a slight axial clearance shown between the insert member 79 and the annular recess 85, for clarity of illustration. It will be apparent to those skilled in the art that, typically, the transverse end surface of the insert member 79 could be in sliding engagement with the adjacent surface of the recess 85, thus limiting or restraining axial movement of the insert member 79, relative to the star member 23. However, the insert member 79 would probably be freely floating within the recess 85, and it is not anticipated that the drive shaft 39 would apply any axial load to the insert member 79, which in turn, would be transferred to the valve spool 53. Referring again to both FIGS. 1 and 2, one beneficial result of the insert member 79 engaging the recess 85 is that the insert member 79 is able to limit the rearward axial motion (i.e., to the right in FIGS. 1 and 2) of the main drive shaft 39. It has long been recognized in the gerotor motor art that a crowned spline-to-straight spline connection exhibits a better wear pattern, and longer life, if relative axial movement therebetween is substantially prevented.

Alternative Embodiment

Additional benefits which can result from the use of the present invention will now be described by means of an alternative embodiment. In order to illustrate and describe various other benefits of the present invention, FIGS. 4 and 5 provide a comparison of a disc valve motor utilizing a valve drive arrangement made in accordance with the "PRIOR ART", and a disc valve motor utilizing the valve drive arrangement of the present invention.

In the embodiment of FIGS. 1 and 3, the valve member was the valve spool 53, the term "spool" in reference to the valve 53 indicating that the valve passages (the timing slots 75 and 77) are disposed on the outer cylindrical surface of the valve spool 53. By way of contrast, in a disc valve motor, the valving action occurs on a flat, transverse surface. A motor of the "disc valve" type is shown and described in greater detail in the above-cited U.S. Pat. No. 4,533,302. However, it will be understood that the term "generally cylindrical" in reference to a valve member, hereinafter and in the claims, includes either a spool valve or a disc valve.

Figure 4:
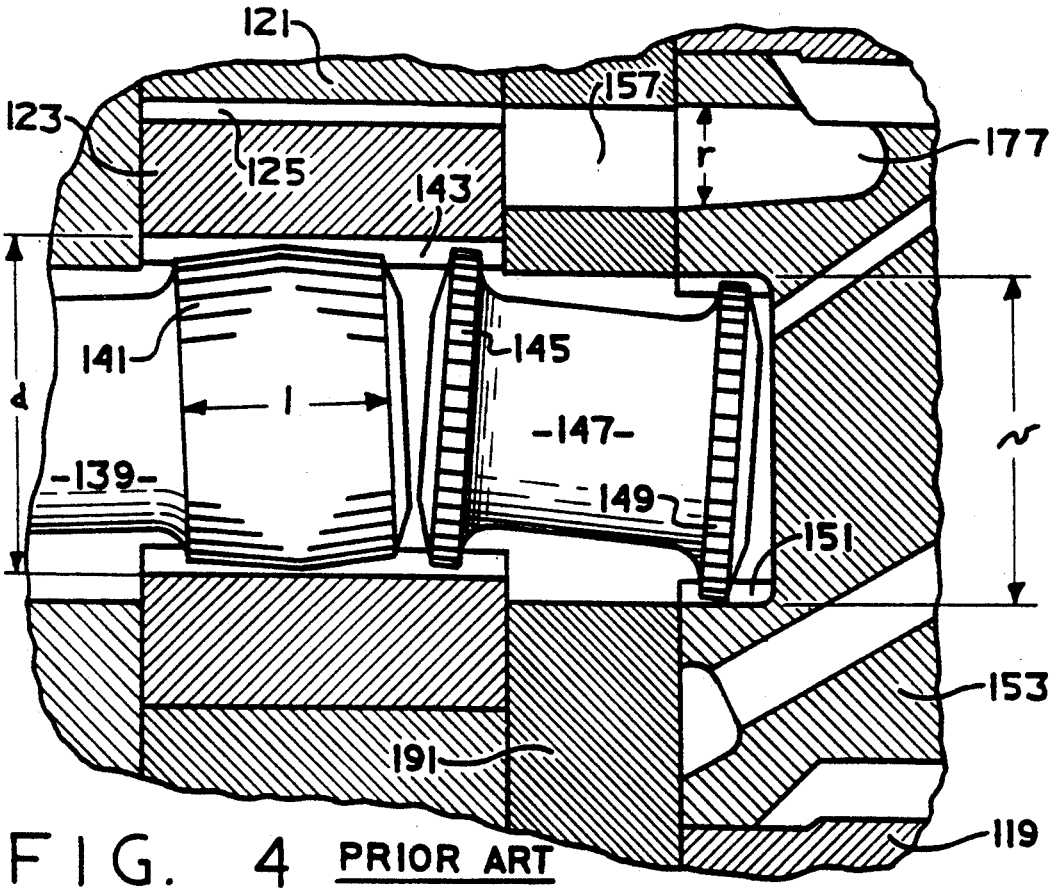
FIG. 4 PRIOR ART
FIG. 4 is a fragmentary, axial cross-section, similar to FIG. 2, illustrating a "PRIOR ART" valve drive arrangement in a disc valve gerotor motor.
Figure 5:
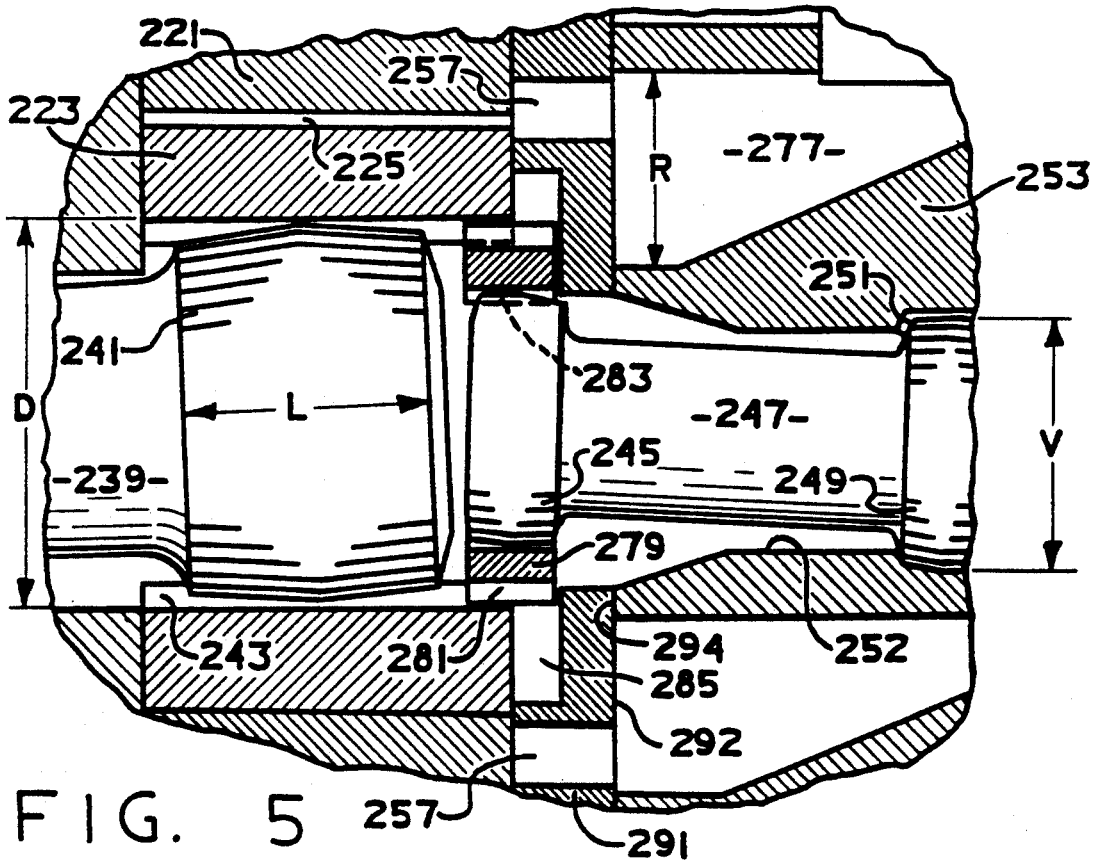
FIG. 5 is a fragmentary, axial cross-section, similar to FIG. 4, illustrating the use of the present invention.

Referring first to FIG. 4, those elements which are the structural and/or functional equivalent of elements in the embodiment of FIGS. 1 through 3 will bear the same reference numeral, plus "100". New elements bear reference numerals in excess of "190".

Disposed between the gerotor ring member 121 and the valve housing section 119 is a stationary valve plate 191, which defines a plurality of fluid ports 157, each of which is in fluid communication with one of the expanding or contracting fluid volume chambers 125.

Referring still to FIG. 4, there are designated certain dimensions of the "PRIOR ART" device which are relevant to the subsequent explanation of additional benefits of the present invention. The pitch diameter of the internal splines 143, of the star member 123, is designated as "d", while the overall axial length of the external, crowned splines 141 is designated as "l". Those dimensions both relate to the torque-transmitting capability of the main drive shaft 139. The diameter of the central opening of the valve member 153 is designated as "v", while the radial dimension of the fluid passages 177 defined by the valve member 153 are designated as "r". In engagement with the internal splines 143 are the external splines 145 of the valve drive shaft 147. The external splines 149 of the shaft 147 are in engagement with the internal splines 151 of the valve member 151.

Referring now to FIG. 5, there is illustrated the application of the present invention to a disc valve motor of the general type shown in FIG. 4. In FIG. 5 elements which are the same, or substantially the same, as in the embodiment of FIGS. 1 through 3, bear the same reference numerals, plus "200". New elements bear reference numerals in excess of "290".

In comparing FIG. 5 to FIG. 4, it may be seen that the axial dimension of the ring member 221 and star member 223 are identical to that of the ring member 121 and star member 123 of the FIG. 4 "PRIOR ART" device. Adjacent the ring member 221 is a stationary valve plate 291 which has substantially less axial thickness than the valve plate 191 shown in FIG. 4, for reasons to be described subsequently.

The star member 223 defines the internal straight splines 243, which are in engagement with the external crowned splines 241 of the main drive shaft 239. Also in engagement with the internal splines 243 is a set of external splines 281, formed about the outer periphery of the insert member 279. About its inner periphery, the insert member 279 defines a set of straight splines 283, in engagement with the external, crowned splines 245 defined at the forward end of the valve drive shaft 247. At the rearward end of the valve drive shaft 247 is a set of external, crowned splines 249, in engagement with a set of internal, straight splines 251 defined by the disc valve member 253. The valve member 253 defines a plurality of fluid passages 277, each of which communicates through a fluid port 257 with one of the expanding or contracting fluid volume chambers 225.

The stationary valve plate 291 also defines the annular recess 285, which receives the portion of the insert member 279, which extends axially beyond (to the right in FIG. 5) the end of the star member 223. The stationary valve plate 291 also defines a stationary valve surface 292, and in sliding engagement therewith is a rotatable valve surface 294, defined by the valve member 253.

The internal splines 243 defined by the star member 223 have a pitch diameter designated as "D", and the overall length of the external, crowned splines 241 is designated "L". By comparing FIG. 5 to FIG. 4, it may be seen that the use of the present invention facilitates the use of a larger drive (i.e., "D" is larger than "d"), and permits a greater length of spline engagement in the main drive area (i.e., "L" is longer than "l"). These two factors contribute to a substantial increase in the torque-transmitting capability of the device shown in FIG. 5.

Referring still to FIG. 5, the central opening 252 defined by the valve member 253 has a diameter designated "V", and the radial dimension of the fluid passages 277 is designated as "R". The use of the valve drive arrangement of the present invention makes it possible for the internal splines 251 and central opening 252 of the valve member 253 to be much smaller than the internal splines 151 of the valve member 153 ("V" is smaller than "v"). As a result, it is possible for the fluid passages 277 in the valve member 253 to have a substantially greater radial dimension than the fluid passages 177 in the valve member 153 ("R" is larger than "r"). In turn, the greater radial dimension of the fluid passages 277 eliminates the need for the fluid ports 257 to undergo a "transition" within the axial length of the valve plate 291, as is required for the fluid ports 157 of the FIG. 4 "PRIOR ART" device. By "transition", it is meant that the fluid ports 257 can have the same flow area and cross-sectional configuration throughout their entire axial extent, whereas the fluid ports 157 are required to change flow area and cross-sectional configuration over their axial extent, thus requiring the valve plate 191 to be thicker axially, with the machining of the valve plate 191 being much more complicated and expensive. By way of contrast, the valve plate 291 can, because of the present invention, be much thinner, and the fluid ports 257 can be formed by any number of relatively less expensive operations, such as by "piercing", or "punching".

Thus, it may be seen that the present invention makes it possible, for any given size of gerotor ring and star, to increase the torque-transmitting capability of the gerotor drive while, at the same time, providing a smaller valve drive shaft, which makes it possible to improve certain dimensional aspects of the valving system.

Although the present invention has been illustrated and described in connection with an embodiment in which the insert member 79 is splined to the star member 23, it should be understood that the invention is not so limited. Instead of being splined to the star member 23, the insert member 79 could have a shape such as square or hexagonal, and be received within a mating recess defined by the star. Alternatively, if the star member 23 were formed from powdered metal, the insert member 79 could be formed integrally with the star, with the star and insert member still having the overall configuration illustrated in the drawings. Both of the above are considered to be included within the scope of the appended claims, except as specifically recited in greater detail.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

I claim:

1. A rotary fluid pressure device of the type including housing means having fluid inlet means and fluid outlet means; fluid energy translating displacement means associated with said housing means, and including a stationary, internally-toothed member, and an externally-toothed member eccentrically disposed within said internally-toothed member and having orbital and rotational movement relative to said internally-toothed member, to define expanding and contracting fluid volume chambers in response to said orbital and rotational movement; valve means cooperating with said housing means to provide fluid communication between said fluid inlet means and said expanding fluid volume chambers, and between said contracting fluid volume chambers and said fluid outlet means; input-output shaft means and means for transmitting torque between said externally-toothed member and said input-output shaft means; said valve means comprising a generally cylindrical valve member defining valving passages and being rotated at the speed of rotation of said externally-toothed member; a valve drive shaft operable to translate said orbital and rotational movement of said externally-toothed member into rotational movement of said valve member; characterized by:

(a) a generally cylindrical insert member being in operable engagement with said externally-toothed member for orbital and rotational movement therewith, at least a substantial portion of said insert member extending axially beyond said externally-toothed member, toward said valve member; and (b) said insert member defining a set of internal, straight splines in engagement with a mating first set of external, crowned splines defined by said valve drive shaft.

2. A rotary fluid pressure device as claimed in claim 1, characterized by said valve member comprising a spool valve member defining said valving passages on its outer cylindrical surface, said spool valve member being disposed immediately adjacent said externally-toothed member, and defining a recess, said portion of said insert member extending axially beyond said externally-toothed member being disposed in said recess, and axially restrained thereby.

3. A rotary fluid pressure device as claimed in claim 1, characterized by said housing means including a stationary valve member disposed immediately adjacent said externally-toothed member, and defining a recess, said portion of said insert member extending axially beyond said externally-toothed member being disposed in said recess, and axially restrained thereby.

4. A rotary fluid pressure device as claimed in claim 3, characterized by said stationary valve member defining a stationary valve surface, oriented generally transverse to an axis of rotation of said device; said valve member defining a rotatable valve surface in valving engagement with said stationary valve surface.

5. A rotary fluid pressure device as claimed in claim 1, characterized by said substantial portion of said insert member extending axially beyond said externally-toothed member comprising approximately one-half of the overall axial length of said insert member.

6. A rotary fluid pressure device as claimed in claim 1, characterized by said means for transmitting torque between said externally-toothed member and said input-output shaft means comprises said mating set of internal, straight splines defined by said externally-toothed member, and a mating set of external, crowned splines defined by a universal drive shaft.

7. A rotary fluid pressure device as claimed in claim 1, characterized by said input-output shaft means being disposed immediately adjacent said insert member, said external, crowned splines defined by said input-output shaft being in splined engagement with said internal, straight splines defined by said externally-toothed member over substantially the entire axial length of said internal, straight splines not engaged by said set of external, straight splines defined by said insert member.

8. A rotary fluid pressure device as claimed in claim 1, characterized by said valve member defining an axially-extending central opening disposed approximately concentrically about said axis of rotation, and extending axially away from said externally-toothed member; said central opening, adjacent its axial end, defining a set of internal, straight splines, substantially identical to said internal, straight splines defined by said insert member, and in engagement with a mating second set of external, crowned splines defined by said valve drive shaft, whereby said valve drive shaft is reversible relative to said sets of internal, straight splines defined by said insert member and by said central opening.

9. A rotary fluid pressure device as claimed in claim 1, characterized by said insert member defining a set of external, straight splines in engagement with a mating set of internal, straight splines defined by said externally-toothed member.

10. A rotary fluid pressure device of the type including housing means having fluid inlet means and fluid outlet means; fluid energy translating displacement means associated with said housing means, and including a stationary, internally-toothed member, and an externally-toothed member eccentrically disposed within said internally-toothed member and having orbital and rotational movement relative to said internally-toothed member, to define expanding and contracting fluid volume chambers in response to said orbital and rotational movement; said externally-toothed member defining a set of internal, straight splines which define a first pitch diameter, valve means cooperating with said housing means to provide fluid communication between said fluid inlet means and said expanding fluid volume chambers, and between said contracting fluid volume chambers and said fluid outlet means; input-output shaft means and means for transmitting torque between said externally-toothed member and said input-output shaft means; said valve means comprising a generally cylindrical valve member defining valving passages and being rotated at the speed of rotation of said externally-toothed member; a valve drive shaft operable to translate said orbital and rotational movement of said externally-toothed member into rotational movement of said valve member; characterized by (a) a generally cylindrical insert member being in operable engagement with said externally-toothed member for orbital and rotational movement therewith, at least a substantial portion of said insert member being disposed axially within said externally-toothed member; and (b) said insert member defining a set of internal, straight splines in engagement with a mating first set of external, crowned splines defined by said valve drive shaft, said internal, straight splines defined by said insert member defining a second pitch diameter, substantially smaller than said first pitch diameter.

11. A rotary fluid pressure device as claimed in claim 10, characterized by at least a substantial portion of said insert member extending axially beyond said externally-toothed member toward said valve member.

12. A rotary fluid pressure device as claimed in claim 10, characterized by said valve member comprising a spool valve member defining said valving passages on its outer cylindrical surface, said spool valve member being disposed immediately adjacent said externally-toothed member, and defining a recess, a portion of said insert member extending axially beyond said externally-toothed member, and being disposed in said recess, and axially restrained thereby.

13. A rotary fluid pressure device as claimed in claim 10, characterized by said housing means including a stationary valve member disposed immediately adjacent said externally-toothed member, and defining a recess, a portion of said insert member extending axially beyond said externally-toothed member, and being disposed in said recess, and axially restrained thereby.

14. A rotary fluid pressure device as claimed in claim 13, characterized by said stationary valve member defining a stationary valve surface, oriented generally transverse to an axis of rotation of said device; said valve member defining a rotatable valve surface in valving engagement with said stationary valve surface.

15. A rotary fluid pressure device as claimed in claim 11, characterized by said substantial portion of said insert member extending axially beyond said externally-toothed member comprising approximately one-half of the overall axial length of said insert member.

16. A rotary fluid pressure device as claimed in claim 10, characterized by said means for transmitting torque between said externally-toothed member and said input-output shaft means comprises said mating set of internal, straight splines defined by said externally-toothed member, and a mating set of external, crowned splines defined by a universal drive shaft.

17. A rotary fluid pressure device as claimed in claim 10, characterized by said input-output shaft means being disposed immediately adjacent said insert member, said external, crowned splines defined by said input-output shaft being in splined engagement with said internal, straight splines defined by said externally-toothed member over substantially the entire axial length of said internal, straight splines not engaged by said set of external, straight splines defined by said insert member.

18. A rotary fluid pressure device as claimed in claim 10, characterized by said valve member defining an axially-extending central opening disposed approximately concentrically about said axis of rotation, and extending axially away from said externally-toothed member; said central opening, adjacent its axial end, defining a set of internal, straight splines, substantially identical to said internal, straight splines defined by said insert member, and in engagement with a mating second set of external, crowned splines defined by said valve drive shaft, whereby said valve drive shaft is reversible relative to said sets of internal, straight splines defined by said insert member and by said central opening.

19. A rotary fluid pressure device as claimed in claim 10, characterized by said insert member defining a set of external, straight splines in engagement with a mating set of internal, straight splines defined by said externally-toothed member.

* * * * *